US005965505A

United States Patent [19]

Baillely et al.

[11] Patent Number: 5,965,505

[45] Date of Patent: Oct. 12, 1999

[54] DETERGENTS CONTAINING A HEAVY METAL SEQUESTRANT AND A DELAYED RELEASE PEROXYACID BLEACH SYSTEM

[75] Inventors: Gerard Marcel Baillely; Janice Jeffrey, both of Newcastle upon Tyne; John Scott Park; Barry Stoddart, both of Tyne & Wear, all of United Kingdom

[73] Assignee: The Procter & Gamble Company, Cincinnati, Ohio

[21] Appl. No.: 08/722,212

[22] PCT Filed: Apr. 3, 1995

[86] PCT No.: PCT/US95/04085

§ 371 Date: Jun. 4, 1997

§ 102(e) Date: Jun. 4, 1997

[87] PCT Pub. No.: WO95/28464

PCT Pub. Date: Oct. 26, 1995

[30] Foreign Application Priority Data

Apr. 13, 1994 [GB] United Kingdom ..... 9407535

[51] Int. Cl.[6] ..... C11D 3/20; C11D 3/26; C11D 3/39; C11D 3/395

[52] U.S. Cl. ..... 510/311; 510/302; 510/303; 510/304; 510/310; 510/312; 510/313; 510/336; 510/337; 510/338; 510/349; 510/361; 510/371; 510/372; 510/376; 510/378

[58] Field of Search ..... 510/302, 303, 510/304, 310, 311, 312, 313, 336, 337, 338, 349, 361, 371, 372, 376, 378

[56] References Cited

U.S. PATENT DOCUMENTS

| | | | |
|---|---|---|---|
| 4,421,664 | 12/1983 | Anderson et al. | 252/94 |
| 4,444,674 | 4/1984 | Gray | 252/95 |
| 5,130,044 | 7/1992 | Mitchell et al. | 252/102 |
| 5,244,594 | 9/1993 | Favre et al. | 252/186.33 |
| 5,246,621 | 9/1993 | Favre et al. | 252/186.33 |
| 5,405,413 | 4/1995 | Willey et al. | 8/111 |
| 5,460,747 | 10/1995 | Gosselink et al. | 252/186.38 |
| 5,500,154 | 3/1996 | Bacon et al. | 252/551 |
| 5,561,235 | 10/1996 | Gosselink et al. | 546/210 |

*Primary Examiner*—Mark Kopec
*Assistant Examiner*—Gregory R. Delcotto
*Attorney, Agent, or Firm*—Pankaj M. Khosla; Ken K. Patel; J. C. Rasser

[57] ABSTRACT

There is a provided a detergent composition containing: (a) a heavy metal ion sequestrant; and (b) an organic peroxyacid bleaching system wherein a means is provided for delaying the release to a wash solution of said peroxyacid bleach relative to the release of said heavy metal ion sequestrant. Preferably said composition additionally contains (c) a water soluble builder wherein a means is provided for delaying the release to a wash solution of said peroxyacid bleach relative to the release of said water soluble builder. A pretreat wash method is also provided.

18 Claims, No Drawings

DETERGENTS CONTAINING A HEAVY METAL SEQUESTRANT AND A DELAYED RELEASE PEROXYACID BLEACH SYSTEM

This invention relates to detergent compositions containing a heavy metal ion sequestrant and an organic peroxyacid bleaching system wherein a means is provided for delaying the release to the wash solution of the organic peroxyacid bleach relative to the release of the heavy metal ion sequestrant.

The satisfactory removal of bleachable soils/stains such as tea, fruit juice and coloured vegetable soils from soiled/stained substrates is a particular challenge to the formulator of a detergent composition for use in a washing method such as a laundry or machine dishwashing method.

Traditionally, the removal of such bleachable soils/stains has been enabled by the use of bleach components such as oxygen bleaches, including hydrogen peroxide and organic peroxyacids. The organic peroxyacids are often obtained by the in situ perhydrolysis reaction between hydrogen peroxide and an organic peroxyacid bleach precursor.

A problem encountered with the use of certain organic peroxyacid bleaches in laundry washing methods is a tendency for these organic peroxyacid bleaches to affect the colour stability of the fabrics in the wash. Types of fabric damage can include fading of coloured dyes on the fabrics or localised areas of "patchy" colour bleaching.

The detergent formulator thus faces the dual challenge of formulating a product which maximises bleachable soil/stain removal but minimises the occurrence of any unwelcome fabric colour stability effects of the bleach.

The Applicants have found that the occurrence of any unwelcome fabric colour stability effects arising from the use of organic peroxyacid bleaches in a washing method can be related to the rate of release of the peroxyacid bleach to the wash solution and also to the absolute level of peroxyacid present in the wash solution.

A fast rate of release of the peroxyacid bleach to the wash solution tends to heighten the probability that unwelcome fabric colour stability effects will be observed, as does a high absolute level of the bleach in the wash solution.

Whilst reducing either the rate of release of the peroxyacid bleach, or the absolute level of the bleach employed in the wash tends to ameliorate this problem, this can be accompanied by a negative effect on the bleachable stain/soil removal ability.

The Applicants have now however found that where a composition containing both a heavy metal ion sequestrant and a peroxyacid bleach source is employed, and wherein a means is provided for delaying the release to a wash solution of the peroxyacid bleach relative to the release of the heavy metal ion sequestrant enhanced bleachable stain/soil removal may be obtained. Additionally, where the composition is used in a laundry washing method a reduction in the propensity for negative fabric colour stability effects to be observed is also obtained.

The Applicants have in addition found that bleachable stain/soil removal benefits may be obtained when a soiled substrate is pretreated with a solution containing a heavy metal ion sequestrant, and optionally a water soluble builder, prior to being washed in a method using a bleach containing detergent product.

It is therefore an object of the present invention to provide compositions suitable for use in laundry and machine dishwashing methods having enhanced bleachable stain removal.

It is also an object of the present invention to provide compositions for use in a laundry washing method wherein said compositions show less propensity to cause negative fabric colour stability effects.

It is a related object of the present invention to provide a stain/soil pretreatment method involving pretreating the soiled substrate with a solution containing a heavy metal ion sequestrant and optionally a water soluble builder, prior to washing with a bleach-containing detergent product.

SUMMARY OF THE INVENTION

According to one aspect of the present invention there is provided a detergent composition containing (a) a heavy metal ion sequestrant, and (b) an organic peroxyacid bleaching system wherein a means is provided for delaying the release to a wash solution of said organic peroxyacid relative to the release of said heavy metal ion sequestrant such that in the T50 test method herein described the time to achieve a concentration that is 50% of the ultimate concentration of the heavy metal ion sequestrant is less than 120 seconds and the time to achieve a concentration that is 50% of the ultimate concentration of the organic peroxyacid is more than 180 seconds.

According to another aspect of the present invention there is provided a detergent composition containing (a) a heavy metal ion sequestrant; and (b) an organic peroxyacid bleaching system wherein a means is provided for delaying the release to a wash solution of said organic peroxyacid relative to the release of said heavy metal ion sequestrant such that in the T50 test method herein described the time to achieve a concentration that is 50% of the ultimate concentration of said heavy metal ion sequestrant is at least 100 seconds, preferably at least 120 seconds, more preferably at least 150 seconds less than the time to achieve a concentration that is 50% of the ultimate concentration of said organic peroxyacid.

Said organic peroxyacid bleaching system preferably comprises in combination (i) a hydrogen peroxide source; and (ii) an organic peroxyacid bleach precursor compound According to a preferred aspect of the present invention said composition additionally contains (c) a water soluble builder wherein a means is provided for delaying the release to a wash solution of the organic peroxyacid relative to the release of said water soluble builder such that in the T50 test method herein described the time to achieve a concentration that is 50% of the ultimate concentration of said water soluble builder is less than 120 seconds and the time to achieve a concentration that is 50% of the ultimate concentration of said organic peroxyacid is more than 180 seconds.

According to another aspect of the present invention there is provided a washing method comprising the steps of:

(1) applying a bleach-free solution of a composition containing a heavy metal ion sequestrant to a soiled substrate;

(2) allowing said solution to remain in contact with said soiled substrate for an effective time interval;

(3) washing said soiled substrate using a washing method involving use of a bleach-containing detergent composition.

Heavy Metal Ion Sequestrant

The detergent compositions of the invention contain a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate) ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2$EDDS and $Na_3$EDDS. Examples of such preferred magnesium complexes of EDDS include MgEDDS and $Mg_2$EDDS.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133.

The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS) is also suitable.

Organic peroxyacid bleaching system

An essential feature of the invention is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

Inorganic perhydrate salts are a preferred source of hydrogen peroxide. These salts are normally incorporated in the form of the alkali metal, preferably sodium salt at a level of from 1% to 40% by weight, more preferably from 2% to 30% by weight and most preferably from 5% to 25% by weight of the compositions.

Examples of suitable inorganic perhydrate salts include perborate, percarbonate, perphosphate, persulfate and persilicate salts and any mixtures thereof. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in compositions in accordance with the invention. Compositions containing percarbonate, have been found to have a reduced tendency to form undesirable gels in the presence of surfactants and water than similar compositions which contain perborate. It is believed that this is because typically percarbonate has a lower surface area and lower porosity than perborate monohydrate. This low surface area and low porosity acts to prevent the co-gelling with fine particles of surfactant agglomerates and is therefore not detrimental to dispensing.

Sodium percarbonate is an addition compound having a formula corresponding to $2Na_2CO_3.3H_2O_2$, and is available commercially as a crystalline solid. The percarbonate is most preferably incorporated into such compositions in a coated form which provides in product stability.

A suitable coating material providing in product stability comprises mixed salt of a water soluble alkali metal sulphate and carbonate. Such coatings together with coating processes have previously been described in GB-1,466,799, granted to Interox on Mar. 9th 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Other coatings which contain silicate (alone or with borate salts or boric acids or other inorganics), waxes, oils, fatty soaps can also be used advantageously within the present invention.

Potassium peroxymonopersulfate is another inorganic perhydrate salt of use in the detergent compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

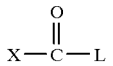

where L is a leaving group and X is essentially any functionality, such that on perhydroloysis the structure of the peroxyacid produced is

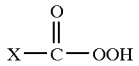

Peroxyacid bleach precursor compounds are preferably incorporated at a level of from 0.5% to 20% by weight, more preferably from 1% to 15% by weight, most preferably from 1.5% to 10% by weight of the detergent compositions. Suitable peroxyacid bleach precursor compounds typically contain one or more N-or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

The Applicants have found that 'patchy' damage can be particularly associated with peroxyacid bleach precursor compounds which on perhydrolysis provides a peroxyacid which is (i) a perbenzoic acid, or non-cationic substituted derivative thereof; or (ii) a cationic peroxyacid.

Benzoxazin precursors have also been found to be particularly susceptible to the problem.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

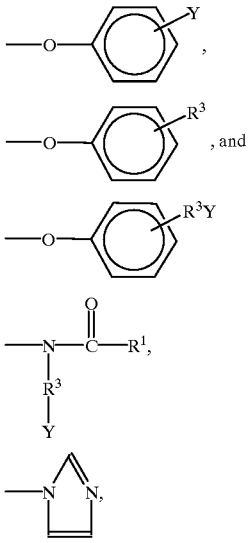

-continued

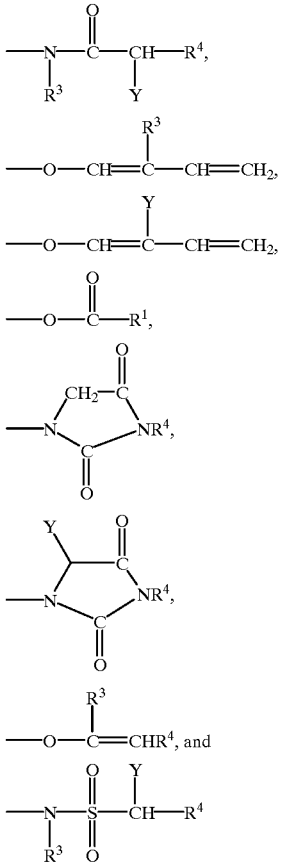

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid, and Derivatives thereof Precursors

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

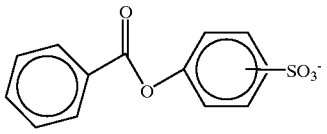

Also suitable are the benzoylation products of sorbitol, glucose, and all saccharides with benzoylating agents, including for example:

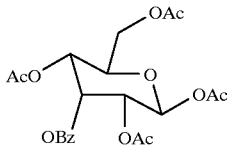

Ac=COCH3; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

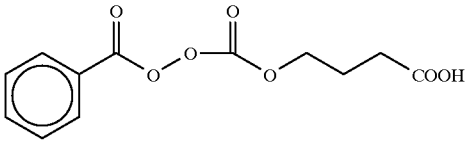

Phthalic anhydride is another suitable perbenzoic acid precursor compound herein:

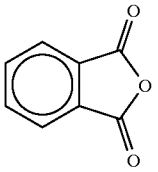

Suitable N-acylated lactam perbenzoic acid precursors have the formula:

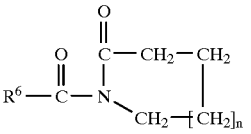

wherein n is from 0 to 8, preferably from 0 to 2, and $R^6$ is an aryl, alkoxyaryl or alkaryl group containing from 1 to 12 carbon atoms, or a substituted phenyl group containing from 6 to 18 carbon atoms, preferably a benzoyl group.

Perbnzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (ie; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

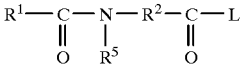

or

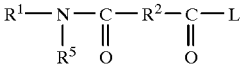

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751.015; 4,988,451; 4,397,757; 5,269,962: 5,127,852: 5,093,022; 5,106,528; U.K. 1,382,594: EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650. 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

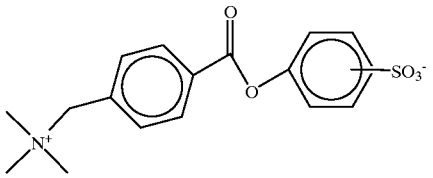

A preferred cationically substituted alkyl oxybenzene sulfonate has the formula:

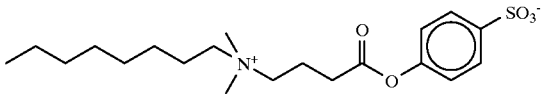

Preferred cationic peroxyacid precursors of the N-acylated caprolactam class include the trialkyl ammonium methylene benzoyl caprolactams, particularly trimethyl ammonium methylene benzoyl caprolactam:

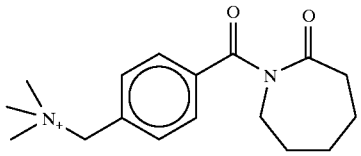

Other preferred cationic peroxyacid precursors of the N-acylated caprolactam class include the trialkyl ammonium methylene alkyl caprolactams:

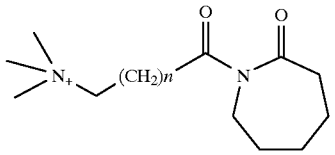

where n is from 0 to 12.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetylethylenediamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are also suitable. including those of the following general formulae:

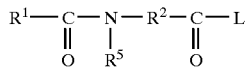

or

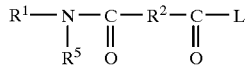

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

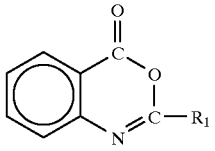

including the substituted benzoxazins of the type

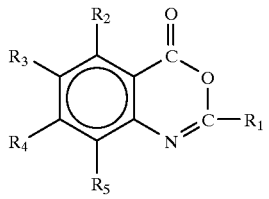

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

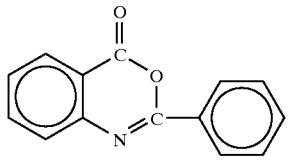

Preformed Organic Peroxyacid

The organic peroxyacid bleaching system may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

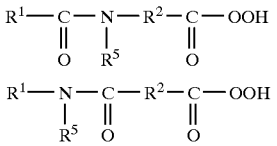

or wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Chlorine Bleach

The compositions herein are preferably free of chlorine bleach.

Bleach Catalyst

The invention also encompasses compositions containing a catalytically effective amount of a bleach catalyst such as a water-soluble manganese salt.

The bleach catalyst is used in a catalytically effective amount in the compositions herein. By "catalytically effective amount" is meant an amount which is sufficient, under whatever comparative test conditions are employed, to enhance bleaching and removal of the stain or stains of interest from the target substrate. Thus, in a fabric laundering operation, the target substrate will typically be a fabric stained with, for example, various food stains. For automatic dishwashing, the target substrate may be, for example, a porcelain cup or plate with tea stain or a polyethylene plate stained with tomato soup. The test conditions will vary, depending on the type of washing appliance used and the habits of the user. Thus, front-loading laundry washing machines of the type employed in Europe generally use less water and higher detergent concentrations than do top-loading U.S.-style machines. Some machines have considerably longer wash cycles than others. Some users elect to use very hot water; others use warn or even cold water in fabric laundering operations.

Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 1 ppm to about 200 ppm of the catalyst species in the laundry liquor. To illustrate this point further, on the order of 3 micromolar manganese catalyst is effective at 40° C., pH 10 under European conditions using perborate and a bleach precursor (e.g., benzoyl caprolactam). An increase in concentration of 3–5 fold may be required under U.S. conditions to achieve the same results. Conversely, use of a bleach precusor and the manganese catalyst with perborate may allow the formulator to achieve equivalent bleaching at lower perborate usage levels than products without the manganese catalyst.

The bleach catalyst material herein can comprise the free acid or be in the form of any suitable salts.

One type of bleach catalyst is a catalyst system comprising a heavy metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl- 1,4,7-triazacyclononane, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$. Still another type of bleach catalyst, as disclosed in U.S. Pat. No. 5 114.606, is a water-soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylithol arabitol, adonitol, meso-erythritol, meso-inositol, lactose, and mixtures thereof. U.S. Pat. No. 5,114,611 teaches a bleach catalyst comprising a complex of transition metals, including Mn, Co, Fe, or Cu, with an non-(macro)-cyclic ligand. Said ligands are of the formula:

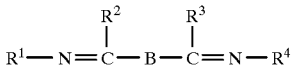

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2\ n^{IV}N_4)^+$ and $[Bipy_2Mn^{III}(u\text{-}O)_2Mn^{IV}bipy_2]\text{-}(ClO_4)_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to add Mn cations in the compositions to ensure its presence in catalytically-effective amounts. Thus, the sodium salt of the ligand and a member selected from the group consisting of $MnSO_4$, $Mn(ClO_4)_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by sparging with nitrogen. The resulting solution is evaporated (under $N_2$, if desired) and the resulting solids are used in the bleaching and detergent compositions herein without further purification.

In an alternate mode, a water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in situ process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of some of the bleach-catalyzing manganesecomplexes described herein have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mnligand species which actually exists, it functions in an apparently catalytic manner to provide improved bleaching performances on stubborn stains such as tea, ketchup, coffee, blood, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4.728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. No. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Relative Release Kinetics

In an essential aspect of the invention a means is provided for delaying the release to a wash solution of the organic peroxyacid bleach relative to the release of the heavy metal ion sequestrant.

Said means may comprise a means for delaying the release of the organic peroxyacid bleach to the wash solution.

Alternatively said means may comprise a means for enhancing the rate of release of the heavy metal ion sequestrant to the solution.

Delayed Rate of Release—Means

The means may provide for delayed release of an organic peroxyacid bleach source itself to the wash solution. Alternatively, where the peroxyacid source is an organic peroxyacid precursor compound the delayed release means may comprise a means of inhibiting, or preventing the in situ perhydrolysis reaction which releases the organic peroxyacid into the solution. Such means could, for example, include delaying release of the hydrogen peroxide source to the wash solution, by for example, delaying release of any inorganic perhydrate salt, acting as a hydrogen peroxide source, to the wash solution.

The delayed release means can include coating any suitable component with a coating or mixture of coatings designed to provide the delayed release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from 1:99 to 1:2, preferably from 1:49 to 1:9.

Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof.

Other suitable coating materials can comprise the alkali and alkaline earth metal sulphates, silicates and carbonates, including calcium carbonate.

Preferred coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and move preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 700,000 and polyethylene glycols (PEG) with an average molecular weight of from 600 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose, ethyl hydroxyethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating compositions may also be applied either by being poured onto, or spray atomized onto a moving bed of bleaching agent.

Other means of providing the required delayed release include mechanical means for altering the physical characteristics of the bleach to control its solubility and rate of release. Suitable protocols could include compaction, mechanical injection, manual injection, and adjustment of the solubility of the bleach compound by selection of particle size of any particulate component.

Whilst the choice of particle size will depend both on the composition of the particulate component, and the desire to meet the desired delayed release kinetics, it is desirable that the particle size should be more than 500 micrometers, preferably having an average particle diameter of from 800 to 1200 micrometers. Additional protocols for providing the means of delayed release include the suitable choice of any other components of the detergent composition matrix such that when the composition is introduced to the wash solution the ionic strength environment therein provided enables the required delayed release kinetics to be achieved.

Enhanced Rate of Release—Means

All suitable means for enhancing the rate of release of the heavy metal ion sequestrant to the solution are envisaged.

The enhanced release means can include coating any suitable component with a coating designed to provide the enhanced release. The coating may therefore, for example, comprise a highly, or even effervescently, water soluble material.

Other means of providing the required delayed release include mechanical means for altering the physical characteristics of the heavy metal ion sequestrant to enhance its solubility and rate of release.

A suitable protocol could include deliberate selection of the particle size of any heavy metal ion sequestrant containing component. The choice of particle size will depend both on the composition of the particulate component, and the desire to meet the desired enhanced release kinetics. It is desirable that the particle size should be less than 1200 micrometers, preferably having an average particle diameter of from 1100 to 500 micrometers.

Additional protocols for providing the means of delayed release include the suitable choice of any other components of the detergent composition matrix, or of any particulate component containing the heavy metal ion sequestrant, such that when the composition is introduced to the wash solution the ionic strength environment therein provided enables the required enhanced release kinetics to be achieved.

Relative Rate of Release—Kinetic Parameters

The release of the organic peroxyacid bleach component from the peroxyacid bleaching system relative to that of the heavy metal ion sequestrant component is such that in the T50 test method herein described the difference between the time to achieve a concentration that is 50% of the ultimate concentration of said heavy metal ion sequestrant is less than 120 seconds, preferably less than 90 seconds, more preferably less than 60 seconds, and the time to achieve a concentration that is 50% of the ultimate concentration of said organic peroxyacid bleach is more than 180 seconds, preferably from 180 to 480 seconds, more preferably from 240 to 360 seconds. In a highly preferred aspect of the invention the release of bleach is such that in the T50 test method herein described the time to achieve a level of total available oxygen (AvO) that is 50% of the ultimate level is more than 180 seconds, preferably from 180 to 480 seconds, more preferably from 240 to 360 seconds. A method for determining AvO levels is disclosed in European Patent Application No. 93870004.4.

In another preferred aspect of the invention, where the peroxyacid bleach source is a peroxyacid bleach precursor, employed in combination with a hydrogen peroxide source the kinetics of release to the wash solution of the hydrogen peroxide relative to those of the heavy metal ion sequestrant component is such that in the T50 test method herein described the time to achieve a concentration that is 50% of the ultimate concentration of said heavy metal ion sequestrant is less than 120 seconds, preferably less than 90 seconds, more preferably less than 60 seconds, and the time to achieve a concentration that is 50% of the ultimate concentration of said hydrogen peroxide is more that 180 seconds, preferably from 180 to 480 seconds. more preferably from 240 to 360 seconds.

The ultimate wash concentration of the heavy metal ion sequestrant is typically from 0.0001% to 0.05% by weight, but preferably is more than 0.001%, more preferably more than 0.002%.

The ultimate wash concentration of any inorganic perhydrate bleach is typically from 0.005% to 0.25% by weight, but preferably is more than 0.05%, more preferably more than 0.075%.

The ultimate wash concentration of any peroxyacid precursor is typically 0.001% to 0.08% by weight, but preferably is from 0.005% to 0.05%, most preferably from 0.015% to 0.05%.

Delayed Release—Test Method

The delayed release kinetics herein are defined with respect to a 'TA test method' which measures the time to achieve A % of the ultimate concentration/level of that component when a composition containing the component is dissolved according to the standard conditions now set out.

The standard conditions involve a 1 liter glass beaker filled with 1000 ml of distilled water at 20° C., to which 10 g of composition is added. The contents of the beaker are agitated using a magnetic stirrer set at 100 rpm. The magnetic stirrer is pea/ovule-shaped having a maximum dimension of 1.5 cm, and a minimum dimension of 0.5 cm. The ultimate concentration/level is taken to be the concentration/level attained 10 minutes after addition of the composition to the water-filled beaker.

Suitable analytical methods are chosen to enable a reliable determination of the incidental, and ultimate in solution concentrations of the component of concern. subsequent to the addition of the composition to the water in the beaker.

Such analytical methods can include those involving a continuous monitoring of the level of concentration of the component, including for example photometric and conductimetric methods.

Alternatively, methods involving removing titres from the solution at set time intervals, stopping the disssolution process by an appropriate means such as by rapidly reducing the temperature of the titre, and then determining the concentration of the component in the titre by any means such as chemical titrimetric methods, can be employed.

Suitable graphical methods, including curve fitting methods, can be employed, where appropriate, to enable calculation of the TA value from raw analytical results.

The particular analytical method selected for determining the concentration of the component, will depend on the nature of that component, and of the nature of the composition containing that component.

Water-Soluble Builder Compound

The detergent compositions of the present invention may contain as a highly preferred component a water-soluble builder compound, typically present at a level of from 1% to 80% by weight, preferably from 10% to 70% by weight, most preferably from 20% to 60% by weight of the composition.

In a highly preferred aspect of the invention a means is also provided for delaying the release to a wash solution of the bleach relative to the release of the preferred water soluble builder component. Said means can comprise equivalents of any of the delayed release means herein described for achieving the delayed release of the bleach components, described hereinbefore.

Said delayed release means is preferably chosen such that in the test method herein described the time to achieve a concentration that is 50% of the ultimate concentration of said water soluble builder is less than 120 seconds, preferably less than 90 seconds, more preferably less than 60 seconds.

The ultimate wash concentration of the water-soluble builder is typically from 0.005% to 0.4%, preferably from 0.05% to 0.35%, more preferably from 0.1% to 0.3%.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol. mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$:$Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Silicates are preferably present in the detergent compositions in accord with the invention at a level of from 5% to 50% by weight of the composition, more preferably from 10% to 40% by weight.

Additional Detergent Components

The detergent compositions of the invention may also contain additional detergent components. The precise nature of these additional components, and levels of incorporation thereof will depend on the physical form of the composition, and the nature of the cleaning operation for which it is to be used.

The compositions of the invention may for example, be formulated as hand and machine laundry detergent compositions, including laundry additive compositions and compositions suitable for use in the pretreatment of stained fabrics and machine dishwashing compositions.

When formulated as compositions suitable for use in a machine washing method, eg: machine laundry and machine dishwashing methods, the compositions of the invention preferably contain one or more additional detergent components selected from surfactants, water-insoluble builders, organic polymeric compounds, additional enzymes, suds suppressors, lime soap dispersants, soil suspension and anti-redeposition agents and corrosion inhibitors. Laundry compositions can also contain, as additional detergent components, softening agents.

Surfactant

The detergent compositions of the invention may contain as an additional detergent component a surfactant selected from anionic, cationic, nonionic ampholytic, amphoteric and zwitterionic surfactants and mixtures thereof.

The surfactant is typically present at a level of from 0.1% to 60% by weight. More preferred levels of incorporation of surfactant are from 1% to 35% by weight, most preferably from 1% to 20% by weight.

The surfactant is preferably formulated to be compatible with any enzyme components present in the composition. In liquid or gel compositions the surfactant is most preferably formulated such that it promotes, or at least does not degrade, the stability of any enzyme in these compositions.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic surfactant

Essentially any anionic surfactants useful for detersive purposes can be included in the compositions. These can include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from about 0.5 to about 20 moles of ethylene oxide per molecule. More preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactant

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein.

Preferred alkyl ethoxy carboxylates for use herein include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Anionic Secondary Soap Surfactant

Preferred soap surfactants are secondary soap surfactants which contain a carboxyl unit connected to a secondary carbon. The secondary carbon can be in a ring structure, e.g. as in p-octyl benzoic acid, or as in allyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3$ $CH(R^4)$ COOM, wherein $R^3$ is $CH_3(CH_2)x$ and $R^4$ is $CH_3(CH_2)y$, wherein y can be O or an integer from 1 to 4, x is an integer from 4 to 10 and the sum of (x+y) is 6 10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$—$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $CH_3(CHR)_k$—$(CH_2)_m$—$(CHR)_n$—$CH(COOM)(CHR)_o$—$(CH_2)_p$—$(CHR)_q$—$CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid. 2-butyl-1-octanoic acid and 2-pentyl-1-heptanoic acid.

Alkali Metal Sarcosinate Surfactant

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Nonionic Surfactant

Essentially any anionic surfactants useful for detersive purposes can be included in the compositions. Exemplary, non-limiting classes of useful nonionic surfactants are listed below.

Nonionic Polyhydroxy Fatty Acid Amide Surfactant

Polyhydroxy fatty acid amides suitable for use herein are those having the structural formula $R^2CONR^1Z$ wherein: $R^1$ is H, $C_1$–$C_4$ hydrocarbyl, 2-hydroxy ethyl, 2-hydroxy propyl, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction: more preferably Z is a glycityl.

Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/Ethylene Diamine adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18. preferably from 12 to 14, carbon atoms; n is 2 or 3; t is from 0 to 10, preferably 0, and X is from 1.3 to 8, preferably from 1.3 to 3, most preferably from 1.3 to 2.7. The glycosyl is preferably derived from glucose.

Nonionic Fatty Acid Amide Surfactant

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Amphoteric Surfactant

Suitable amphoteric surfactants for use herein include the amine oxide surfactants and the alkyl amphocarboxylic acids.

A suitable example of an alkyl aphodicarboxylic acid for use herein is Miranol(TM) C2M Conc. manufactured by Miranol, Inc., Dayton, N.J.

Amine Oxide Surfactant

Amine oxides useful herein include those compounds having the formula

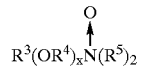

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide. stearyl dimethylamine oxide, tallow dimethylamine oxide and dimethyl-2-hydroxyoctadecylamine oxide, Preferred are $C_{10}$–$C_{18}$ alkyl dimethylamine oxide. and $C_{10-18}$ acylamido alkyl dimethylamine oxide.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Betaine Surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Sultaine Surfactant

The sultaines useful herein are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Ampholytic Surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched.

Cationic Surfactants

Cationic surfactants can also be used in the detergent compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Partially Soluble or Insoluble Builder Compound

The detergent compositions of the present invention may contain a partially soluble or insoluble builder compound, typically present at a level of from 1% to 80% by weight, preferably from 10% to 70% by weight, most preferably from 20% to 60% weight of the composition.

Examples of partially water soluble builders include the crystalline layered silicates. Examples of largely water insoluble builders include the sodium aluminosilicates Crystalline layered sodium silicates have the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0 164514 and methods for their preparation are disclosed in DE-A-3417649 and DE-A-3742043. For the purpose of the present invention, x in the general formula above has a value of 2, 3 or 4 and is preferably 2. The most preferred material is δ-$Na_2Si_2O_5$, available from Hoechst AGas NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Suitable aluminosilicate zeolites have the unit cell formula $Na_z[(AlO_2)_z(SiO_2)y].XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate ion exchange materials can be naturally occurring materials, but are preferably synthetically derived. Synthetic crystalline aluminosilicate ion exchange materials are available under the designations Zeolite A, Zeolite B, Zeolite P. Zeolite X, Zeoilte MAP Zeolite HS and mixtures thereof. Zeolite A has the formula $$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}]$. 276 $H_2O$.

Enzyme

Another optional ingredient useful in the detergent compositions is one or more additional enzymes.

Preferred additional enzymatic materials include the commercially available lipases, amylases, neutral and alkaline proteases, esterases, cellulases, pectinases, lactases and peroxidases conventionally incorporated into detergent compositions. Suitable enzymes are discussed in U.S. Pat. No. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition. Preferred amylases include, for example, α-amylases obtained from a special strain of B licheniformis, described in more detail in GB-1, 269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein.

A preferred lipase is derived from *Pseudomonas pseudoalcaligenes,* which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Enzyme Stabilizing System

Preferred enzyme-containing compositions herein may comprise from about 0.001% to about 10%, preferably from about 0.005% to about 8%,most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof. Such stabilizing systems can also comprise reversible enzyme inhibitors, such as reversible protease inhibitors.

The compositions herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during washing is usually large; accordingly, enzyme stability in-use can be problematic.

Suitable chlorine scavenger anions are widely available, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired.

Organic Polymeric Compound

Organic polymeric compounds are particularly preferred components of the detergent compositions in accord with the invention. By organic polymeric compound it is meant essentially any polymeric organic compound commonly used as dispersants, and anti-redeposition and soil suspension agents in detergent compositions.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo-or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 100,000, especially 40,000 to 80,000.

Other suitable organic polymeric compounds include the polymers of acrylamide and acrylate having a molecular weight of from 3,000 to 100,000, and the acrylate/fumarate copolymers having a molecular weight of from 2,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000 are also suitable herein.

Other organic polymeric compounds suitable for incorporation in the detergent compositions herein include cellulose derivatives such as methylcellulose, carboxymethylcellulose and hydroxyethylcellulose.

Further useful organic polymeric compounds are the polyethylene glycols, particularly those of molecular weight 1000–10000, more particularly 2000 to 8000 and most preferably about 4000.

Lime Soap Dispersant Compound

The compositions of the invention may contain a lime soap dispersant compound, which has a lime soap dispersing power (LSDP), as defmed hereinafter of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to, for example, in the following review articles; W. N. Linfield, Surfactant Science Series, Volume 7, p3; W. N. Linfield, Tenside Surf. Det. , Volume 27, pages 159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Surfactants having good lime soap dispersant capability will include certain amine oxides, betaines, suffobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

Polymeric lime soap dispersants suitable for use herein are described in the article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Suds Suppressing System

The detergent compositions of the invention, when formulated for use in machine washing compositions, preferably comprise a suds suppressing system present at a level of from 0.01% to 15%, preferably from 0.05% to 10%, most preferably from 0. 1% to 5% by weight of the composition.

Suitable suds suppressing systems for use herein may comprise essentially any known antifoam compound, including, for example silicone antifoam compounds, 2-alkyl and alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein. Suitable 2-alky-alcanols antifoam compounds for use herein have been described in DE 40 21 265. The 2-alkyl-alcanols suitable for use herein consist of a $C_6$ to $C_{16}$ alkyl chain carrying a terminal hydroxy group, and said alkyl chain is substituted in the a position by a $C_1$ to $C_{10}$ alkyl chain. Mixtures of 2-alkyl-alcanols can be used in the compositions according to the present invention.

A preferred suds suppressing system comprises (a) antifoam compound preferably silicone antifoam compound, most preferably a silicone antifoam compound comprising in combination
  (i) polydimethyl siloxane, at a level of from 50% to 99%, preferably 75% to 95% by weight of the silicone antifoam compound;
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DC0544, commercially available from DOW Corning under the tradename DC0544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A preferred particulate suds suppressor system useful herein comprises a mixture of an alkylated siloxane of the type hereinabove disclosed and solid silica.

The solid silica can be a fumed silica, a precipitated silica or a silica, made by the gel formation technique. The silica particles suitable have an average particle size of from 0.1 to 50 micrometers, preferably from 1 to 20 micrometers and a surface area of at least 5 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. A preferred particulate antifoam compound for inclusion in the detergent compositions in accordance with the invention suitably contain an amount of silica such that the weight ratio of silica to silicone lies in the range from 1:100 to 3:10, preferably from 1:50 to 1:7.

Another suitable particulate suds suppressing system is represented by a hydrophobic silanated (most preferably trimethyl-silanated) silica having a particle size in the range from 10 nanometers to 20 nanometers and a specific surface area above 50 $m^2$ /g, intimately admixed with dimethyl silicone fluid having a molecular weight in the range from about 500 to about 200,000 at a weight ratio of silicone to silanated silica of from about 1:1 to about 1:2.

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C. Other highly preferred particulate suds suppressing systems are described in copending European Application 91870007.1 in the name of the Procter and Gamble Company which systems comprise silicone antifoam compound, a carrier material, an organic coating material and glycerol at a weight ratio of glycerol: silicone antifoam compound of 1:2 to 3:1. Copending European Application 91201342.0 also discloses highly preferred particulate suds suppressing systems comprising silicone antifoam compound, a carrier material, an organic coating material and crystalline or amorphous aluminosilicate at a weight ratio of aluminosilicate: silicone antifoam compound of 1:3 to 3:1. The preferred carrrier material in both of the above described highly preferred granular suds controlling agents is starch.

An exemplary particulate suds suppressing system for use herein is a particulate agglomerate component, made by an agglomeration process, comprising in combination (i) from 5% to 30%, preferably from 8% to 15% by weight of the component of silicone antifoam compound, preferably comprising in combination polydimethyl siloxane and silica;

(ii) from 50% to 90%, preferably from 60% to 80% by weight of the component, of carrier material, preferably starch;

(iii) from 5% to 30%, preferably from 10% to 20% by weight of the component of agglomerate binder compound, where herein such compound can be any compound, or mixtures thereof typically employed as binders for agglomerates, most preferably said agglomerate binder compound comprises a $C_{16}$–$C_{18}$ ethoxylated alcohol with a degree of ethoxylation of from 50 to 100; and (iv) from 2% to 15%, preferably from 3% to 10%, by weight of $C_{12}$–$C_{22}$ hydrogenated fatty acid.

Polymeric Dye Transfer Inhibiting Agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

a) Polyamine N-Oxide Polymers

Polyamine N-oxide polymers suitable for use herein contain units having the following structure formula:

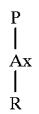

(I)

wherein P is a polymerisable unit, whereto the R—N—O group can be attached to, or wherein the R—N—O group forms part of the polymerisable unit or a combination of both.

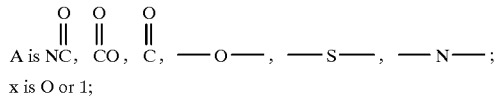

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

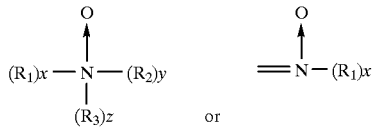

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups. The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit.

Preferred class of these polyamine N-oxides are the polyamine N-oxides having the general formula (I) wherein R is an aromatic,heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power. Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

Preferred polymers for use herein may comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The preferred N-vinylimidazole N-vinylpyrrolidone copolymers have a molar ratio of N-vinylimidazole to N-vinylpyrrolidone from 1 to 0.2, more preferably from 0.8 to 0.3, most preferably from 0.6 to 0.4.

c) Polyvinylpyrrolidone

The detergent compositions herein may also utilize polyvinylpyrrolidone ("PVP") having an average molecular weight of from 2,500 to 400,000, preferably from 5,000 to 200,000, more preferably from 5,000 to 50,000, and most preferably from 5,000 to 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Cooperation include Sokalan HP 165 and Sokalan HP 12.

Polyvinylpyrrolidone may be incorporated in the detergent compositions herein at a level of from 0.01% to 5% by weight of the detergent, preferably from 0.05% to 3% by weight, and more preferably from 0.1% to 2% by weight. The amount of polyvinylpyrrolidone delivered in the wash solution is preferably from 0.5 ppm to 250 ppm, preferably from 2.5 ppm to 150 ppm, more preferably from 5 ppm to 100 ppm.

d) Polvvinyloxazolidone

The detergent compositions herein may also utilize polyvinyloxazolidones as polymeric dye transfer inhibiting agents. Said polyvinyloxazolidones have an average molecular weight of from 2,500 to 400,000, preferably from 5,000 to 200,000, more preferably from 5,000 to 50,000, and most preferably from 5,000 to 15,000.

The amount of polyvinyloxazolidone incorporated in the detergent compositions may be from 0.01% to 5% by weight, preferably from 0.05% to 3% by weight, and more preferably from 0.1% to 2% by weight. The amount of polyvinyloxazolidone delivered in the wash solution is typically from 0.5 ppm to 250 ppm, preferably from 2.5 ppm to 150 ppm, more preferably from 5 ppm to 100 ppm.

e) Polyvinylimidazole

The detergent compositions herein may also utilize polyvinylimidazole as polymeric dye transfer inhibiting agent. Said polyvinyilmidazoles preferably have an average molecular weight of from 2,500 to 400,000, more preferably from 5,000 to 50,000, and most preferably from 5,000 to 15,000.

The amount of polyvinylimidazole incorporated in the detergent compositions may be from 0.01% to 5% by weight, preferably from 0.05% to 3% by weight, and more preferably from 0.1% to 2% by weight. The amount of polyvinylimidazole delivered in the wash solution is from 0.5 ppm to 250 ppm, preferably from 2.5 ppm to 150 ppm, more preferably from 5 ppm to 100 ppm.

Optical Brightener

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

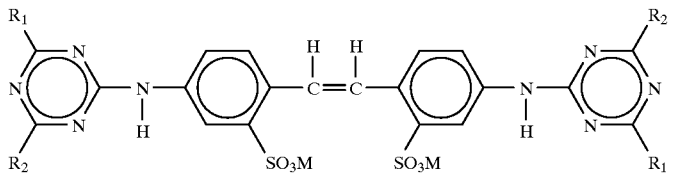

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Softening Agents

Fabric softening agents can also be incorporated into laundry detergent compositions in accordance with the present invention. These agents may be inorganic or organic in type. Inorganic softening agents are exemplified by the smectite clays disclosed in GB-A-1 400 898. Organic fabric softening agents include the water insoluble tertiary amines as disclosed in GB-A-1 514 276 and EP-B-0 011 340.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight.

Other Optional Ingredients

Other optional ingredients suitable for inclusion in the compositions of the invention include perfumes, colours and filler salts, with sodium sulfate being a preferred filler salt.

Form of the Compositions

The detergent compositions of the invention can be formulated in any desirable form such as powders, granulates, pastes, liquids and gels.

Liquid Compositions

The detergent compositions of the present invention may be formulated as liquid detergent compositions. Such liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel Compositions

The detergent compositions of the present invention may also be in the form of gels. Such compositions are typically formulated with polyakenyl polyether having a molecular weight of from about 750,000 to about 4,000,000.

Solid Compositions

The detergent compositions of the invention are preferably in the form of solids, such as powders and granules.

The particle size of the components of granular compositions in accordance with the invention should preferably be such that no more that 5% of particles are greater than 1.4 mm in diameter and not more than 5% of particles are less than 0.15 mm in diameter.

The bulk density of granular detergent compositions in accordance with the present invention typically have a bulk density of at least 450 g/liter, more usually at least 600 g/liter and more preferably from 650 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrial cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

Making Processes—Granular Compositions

In general, granular detergent compositions in accordance with the present invention can be made via a variety of methods including dry mixing, spray drying, agglomeration and granulation.

Washing Methods

The compositions of the invention may be used in essentially any washing or cleaning method, including machine laundry and dishwashing methods.

Machine Dishwashing Method

A preferred machine dishwashing method comprises treating soiled articles selected from crockery, glassware, hollowware and cutlery and mixtures thereof, with an aqueous liquid having dissolved or dispensed therein an effective amount of a machine dishwashing composition in accord with the invention. By an effective amount of the machine dishwashing composition it is typically meant from 8 g to 60 g of product dissolved or dispersed in a wash solution of volume from 3 to 10 liters, as are typical product dosages and wash solution volumes commonly employed in conventional machine dishwashing methods.

Machine Laundry Methods

Machine laundry methods herein comprise treating soiled laundry with an aqueous wash solution in a washing machine having dissolved or dispensed therein an effective amount of a machine laundry detergent composition in accord with the invention. The detergent can be added to the wash solution either via the dispenser drawer of the washing machine or by a dispensing device. By an effective amount of the detergent composition it is typically meant from 40 g to 300 g of product dissolved or dispersed in a wash solution of volume from 5 to 65 liters, as are typical product dosages and wash solution volumes commonly employed in conventional machine laundry methods.

In a preferred washing method herein a dispensing device containing an effective amount of detergent product is introduced into the drum of a, preferably front-loading, washing machine before the commencement of the wash cycle.

The dispensing device is a container for the detergent product which is used to deliver the product directly into the drum of the washing machine. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its immersion in the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of components such as water-soluble builder and heavy metal ion sequestrant components in the drum of the washing machine at this stage of the wash cycle.

Preferred dispensing devices are reusable and are designed in such a way that container integrity is maintained in both the dry state and during the wash cycle. Especially preferred dispensing devices for use in accord with the invention have been described in the following patents; GB-B-2, 157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly know as the "granulette".

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Pretreatment washing method

In a pretreatment wash method aspect of the invention a soiled/stained substrate is treated with an effective amount of a pretreatment solution containing a heavy metal ion sequestrant, but no bleach components. The solution might optionally contain other non-bleach detergent components such as surfactants, builders, enzymes and detergent polymers. Preferably the solution also contains water-soluble builder.

The level of the heavy metal ion sequestrant in said pretreatment solution is typically from 0.0005% to 1%, and preferably is more than 0.05%.

The pretreatment solution is allowed to remain in contact with the soiled substrate for an effective time interval. Said time interval will typically be from 10 seconds to 1800 seconds, more preferably from 60 seconds to 600 seconds.

The soiled substrate is then washed using a suitable washing method wherein a bleach-containing detergent product is employed. The washing method may for example, be any of the machine dishwashing or machine laundry washing methods described herein.

In the detergent compositions, the abbreviated component identifications have the following meanings:

| | |
|---|---|
| XYAS | Sodium $C_{1X}$–$C_{1Y}$ alkyl sulfate |
| 24EY | A $C_{12-14}$ predominantly linear primary alcohol condensed with an average of Y moles of ethylene oxide |
| XYEZ | A $C_{1x}$–$C_{1y}$ predominantly linear primary alcohol condensed with an average of Z moles of ethylene oxide |
| XYEZS | $C_{1X}$–$C_{1Y}$ sodium alkyl sulfate condensed with an average of Z moles of ethylene oxide per mole |
| TFAA | $C_{16}$–$C_{18}$ alkyl N-methyl glucamide. |
| Silicate | Amorphous Sodium Silicate ($SiO_2$:$Na_2O$ ratio = 2.0) |
| NaSKS-6 | Crystalline layered silicate of formula $\delta$-$Na_2Si_2O_5$ |
| Carbonate | Anhydrous sodium carbonate |
| Polycarboxylate | Copolymer of 1:4 maleic/acrylic acid, average molecular weight about 80,000 |
| Zeolite A | Hydrated Sodium Aluminosilicate of formula $Na_{12}(AlO_2SiO_2)_{12}.27H_2O$ having a primary particle size in the range from 1 to 10 micrometers |
| Citrate | Tri-sodium citrate dihydrate |
| Percarbonate (fast release particle) | Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate to mixed salt is 39:1 |
| Percarbonate (slow release particle) | Anhydrous sodium percarbonate bleach coated with a coating of sodium silicate ($Si_2O$:$Na_2O$ ratio = 2:1) at a weight |

-continued

| | |
|---|---|
| | ratio of percarbonate to sodium silicate of 39:1 |
| TAED | Tetraacetylethylenediamine |
| TAED (slow release particle) | Particle formed by agglomerating TAED with citric acid and polyethylene glycol (PEG) of Mw = 4,000 with a weight ratio of components of TAED:citric acid:PEG of 75:10:15, coated with an external coating of citric acid at a weight ratio of agglomerate: citric acid coating of 95:5. |
| Benzoyl Caprolactam (slow release particle) | Particle formed by agglomerating benzoyl caprolactam (BzCl) with citric acid and polyethylene glycol (PEG) of Mw = 4,000, with a weight ratio of components of BzCl:citric acid:PEG of 63:21:16, coated with an external coating of citric acid at a weight ratio of agglomerate:citric acid coating of 95:5 |
| TAED (fast release particle) | Particle formed by agglomerating TAED with partially neutralised polycarboxylate at a ratio of TAED:polycarboxylate of 93:7, coated with an external coating of polycarboxylate at a weight ratio of agglomerate:coating of 96:4 |
| EDDS (fast release particle) | Particle formed by spray-drying EDDS with $MgSO_4$ at a weight ratio of 26:74 |
| Protease | Proteolytic enzyme sold under the tradename Savinase by Novo Industries A/S with an activity of 13 KNPU/g. |
| Amylase | Amylolytic enzyme sold under the tradename Termamyl 60T by Novo Industries A/S with an activity of 300 KNU/g |
| Cellulase | Cellulosic enzyme sold by Novo Industries A/S with an activity of 1000 CEVU/g |
| Lipase | Lipolytic enzyme sold under the tradename Lipolase by Novo Industries A/S with an activity of 165 KLU/g |
| CMC | Sodium carboxymethyl cellulose |
| HEDP | 1,1-hydroxyethane diphosphonic acid |
| EDDS | Ethylenediamine-N,N'-disuccinic acid, [S,S] isomer in the form of the sodium salt. |
| PVNO | Poly (4-vinylpyridine)-N-oxide copolymer of vinylimidaxole and vinylpyrrolidone having an average molecular weight of 10,000. |
| Granular Suds Suppressor | 12% Silicone/silica, 18% stearyl alcohol, 70% starch in granular form |
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh (low foaming) |
| Metasilicate | Sodium metasilicate ($SiO_2$:$Na_2O$ ratio = 1.0) |
| Phosphate | Sodium tripolyphosphate |
| 480N | Random copolymer of 3:7 acrylic/methacrylic acid, average molecular weight about 3,500 |
| PB1 | Anydrous sodium perborate monohydrate - in compacted particulate form to retard release of hydrogen peroxide |
| Cationic lactam | Cationic peroxyacid bleach precursor salt of trialkyl ammonium methylene $C_5$-alkyl caprolactam with tosylate |
| DETPMP | Diethylene triamine penta (methylene phosphonic acid), marketed by Monsanto under the tradename Dequest 2060 |
| Bismuth nitrate | Bismuth nitrate salt |
| Paraffin | Paraffin oil sold under the tradename Winog 70 by Wintershall. |
| BSA | Amylolytic enzyme sold under the tradename LE17 by Novo Industries A/S (approx 1% enzyme activity) |
| Sulphate | Anhydrous sodium sulphate. |
| pH | Measured as a 1% solution in distilled water at 20° C. |

EXAMPLE 1

The following laundry detergent compositions were prepared values being expressed as percentages by weight of the compositions: Composition A is a comparative composition, compositions B to E are in accord with the invention:

| | A | B | C | D | E |
|---|---|---|---|---|---|
| 45AS/25AS (3:1) | 9.1 | 9.1 | 9.1 | 9.1 | 7.0 |
| 35AE3S | 2.3 | 2.3 | 2.3 | 2.3 | 2.0 |
| 24E5 | 4.5 | 4.5 | 4.5 | 4.5 | 6.0 |
| TFAA | 2.0 | 2.0 | 2.0 | 2.0 | — |
| Zeolite A | 13.2 | 13.2 | 13.2 | 13.2 | 15.0 |
| Na SKS-6/citric acid (79:21) | 15.6 | 15.6 | 15.6 | 15.6 | 13.0 |
| Carbonate | 7.6 | 7.6 | 7.6 | 7.6 | 8.0 |
| TAED (fast release particle) | 6.3 | — | — | — | — |
| TAED (slow release particle) | — | 5.0 | — | 2.3 | 3.5 |
| Benzoyl Caprolactam (slow release particle) | — | — | 5.0 | 2.7 | — |
| Percarbonate (fast release particle) | 22.5 | — | — | 22.5 | — |
| Percarbonate (slow release particle) | — | 22.5 | 22.5 | — | — |
| PB1 | — | — | — | — | 16.0 |
| DETPMP | 0.5 | — | — | — | 0.3 |
| EDDS (fast release particle) | — | 0.8 | 0.3 | 0.75 | — |
| Protease | 0.55 | 1.27 | 0.55 | 1.27 | 1.5 |
| Lipase | 0.15 | 0.15 | 0.15 | 0.15 | 0.2 |
| Cellulase | 0.28 | 0.28 | 0.28 | 0.28 | 0.4 |
| Amylase | 0.27 | 0.27 | 0.27 | 0.27 | 0.4 |
| Polycarboxylate | 5.1 | 5.1 | 5.1 | 5.1 | 4.0 |
| CMC | 0.4 | 0.4 | 0.4 | 0.4 | 0.4 |
| PVNO | 0.03 | 0.03 | 0.03 | 0.03 | — |
| Granular suds suppressor | 1.5 | 1.5 | 1.5 | 1.5 | 1.5 |
| Minors/misc to 100% | | | | | |

The following T50 values (in seconds) were obtained for each of products A to D:

| T50 | A | B | C | D |
|---|---|---|---|---|
| Peroxyacid | 130 | 190 | 205 | 240 |
| AVO | 95 | 225 | 230 | 115 |
| Builder (citric) | 90 | 60 | 60 | 60 |
| Heavy metal ion sequestrant (DETPMP or EDDS) | 150 | 30 | 30 | 60 |

Comparative Testing

Test Method—Stain Removal

Swatch Preparation

Three white cotton sheets were prewashed in a non-biological bleach-free heavy duty detergent. Sets of six test swatches of size 6 cm×6 cm were cut from each sheet. Stains were evenly applied onto each swatch set (e.g. by painting on).

Additionally, pre-prepared swatches obtained from the EMPA institute were also employed.

In summary, the following sets of swatches were employed:

Enzymatic stains

Grass;

Bleachable stains

EMPA Blood;

EMPA Blood Milk and Ink;

Greasy stains

Dirty Motor Oil;

Shoe Polish;

The sets of fabric swatches were subjected to one wash cycle in an automatic washing machine. The swatches were then assessed for removal of the stains by an expert panel using a four point Scheffe scale. The combined averaged paired results of each of the sets of comparisons are as set out below, with prior art composition A being used as the common reference.

In more detail, a Miele 698 WM automatic washing machine was employed, and the 40° C. short cycle programme selected. Water of 120° German hardness (Ca: Mg=3:1) was used. 75 g of detergent, dispensed from a granulette dispensing device placed in the middle of the load was employed. One swatch of each type was washed along with a ballast load of 2.7 Kg of lightly soiled sheets (1 weeks domestic usage).

Comparative Testing—Stain Removal

The above stain removal test method was followed in comparing the efficiency of Composition B with the reference prior art Composition A in removing different type of stains.

The results obtained were as follows:

| Stain type | Stain removal benefit (PSU) |
|---|---|
| EMPA blood | +1.8* |
| EMPA BMI | +0.6 |
| Grass | +0.7 |
| Dirty Motor Oil | +0.6 |
| Shoe polish | +0.7 |

*significant at 95% confidence limit

EXAMPLE 2

The following bleach-containing machine dishwashing compositions were prepared (parts by weight) in accord with the invention.

| | A | B | C | D | E | F | G |
|---|---|---|---|---|---|---|---|
| Citrate | 15.0 | 15.0 | 15.0 | 15.0 | 15.0 | 15.0 | — |
| 480N | 6.0 | 6.0 | 6.0 | 6.0 | 6.0 | 6.0 | — |
| Carbonate | 17.5 | 17.5 | 17.5 | 17.5 | 17.5 | 17.5 | — |
| Phosphate | — | — | — | — | — | — | 38.0 |
| Silicate (as $SiO_2$) | 8.0 | 8.0 | 8.0 | 8.0 | 8.0 | 8.0 | 14.0 |
| Metasilicate (as $SiO_2$) | 1.2 | 1.2 | 1.2 | 1.2 | 1.2 | 1.2 | 2.5 |
| PB1 - slow release particle (AvO) | 1.2 | 1.2 | 1.5 | 1.5 | 1.5 | 2.2 | 1.2 |
| TAED (slow release particle) | 2.2 | 2.2 | 2.2 | 3.5 | — | 2.2 | 2.2 |
| Cationic lactam | — | — | — | — | 3.3 | — | — |
| Paraffin | 0.5 | 0.5 | 0.5 | 0.5 | 0.5 | 0.5 | 0.5 |
| Bismuth nitrate | — | 0.2 | 0.2 | 0.2 | 0.3 | 0.4 | 0.2 |
| Protease | 2.0 | 2.0 | 2.0 | 2.0 | 2.0 | 2.0 | 2.0 |
| Amylase | 1.5 | 1.5 | 1.5 | 1.5 | 1.5 | 1.5 | — |
| BSA | — | — | — | — | — | — | 1.5 |
| DETPMP | 0.13 | 0.13 | 0.13 | 0.13 | 0.13 | 0.13 | — |
| HEDP | 1.0 | 1.0 | 1.0 | 1.0 | 1.0 | 1.0 | — |
| Nonionic | 2.0 | 2.0 | 2.0 | 2.0 | 2.0 | 2.0 | 1.5 |
| Sulphate misc inc moisture to balance | 23.0 | 22.8 | 22.4 | 22.7 | 22.2 | 21.5 | 0.3 |
| pH (1% solution) | 10.7 | 10.7 | 10.7 | 10.7 | 10.7 | 10.7 | 11.0 |

EXAMPLE 3

The following representative beaker test method was carried out to determine whether the sequential order of exposure of a stained fabric to heavy metal ion sequestrant and hydrogen peroxide bleach solution would give rise to differences in the stain removal profile.

Pre-stained cotton swatches were prepared by immersing the swatches in a concentrated tea solution. Tea stains contain high levels of manganese, and are recognised to be difficult to remove from soiled/stained substrates.

Individual 1000 ml beakers were charged with solutions containing individually 0.5% by weight concentration of EDDS, and a hydrogen peroxide solution equivalent to 2% AvO. Each of the heavy metal ion sequestrant and bleach solutions was buffered to a pH of 10.5, which is a typical "in wash" pH encountered in a laundry washing method.

Sets of the pre-stained swatches were subjected to soaking in either, or sequentially both, of the solutions. The soak time in each solution was 20 minutes. Each soak was followed by a rinse in dilute NaOH solution.

In detail, the following wash/soak protocols were employed:

| Set | Protocol |
|---|---|
| A | Soaking in bleach solution only |
| B | Soaking in EDDS solution only |
| C | Soaking in bleach solution followed by soaking in EDDS solution |
| D | Soaking in EDDS solution followed by soaking in bleach solution |

The stain removal results achieved for each wash/soak protocol were assessed using a Macbeth Spectrometer, measuring the yellowness, whiteness and a, b and 1 values, by comparison with a clear white cotton swatch.

The following results were obtained:

| | Stained swatch | A | B | C | D |
|---|---|---|---|---|---|
| Yellowness | 55.1 | 35.7 | 36.7 | 29.4 | 19.3 |
| Whiteness | −141.2 | −92.1 | −94.1 | −75.0 | −50.1 |
| 1 | −9.7 | −5.8 | −8.6 | −4.5 | −3.4 |
| a | 3.5 | −.3 | 2.3 | 0.0 | −0.7 |
| b | 23.8 | 16.1 | 15.5 | 13.4 | 8.9 |

Less positive yellowness, a and b values are desirable. More positive whiteness and 1 values are desirable.

The stain removal results for the set of swatches D are hence seen to be better than those obtained for swatches A–C. The enhanced stain removal performance obtained for the sequential exposure of a stained fabric to a heavy metal ion sequestrant containing solution prior to a bleach-containing solution is thus demonstrated.

EXAMPLE 4

The following representative test method demonstrates that significant bleachable stain removal performance is obtained when stained swatches are treated with a solution containing heavy metal ion sequestrant prior to being washed in a bleach-containing detergent product having fast (i.e. uncontrolled rate of release of bleach).

Pre-stained cotton swatches were prepared by immersing the swatches in a concentrated tea solution. Tea stains contain high levels of manganese, and are recognised to be difficult to remove from soiled/stained substrates.

Individual 1000 ml beakers were charged with solutions containing 0.005% by weight concentration of EDDS buffered to a pH of 10.5, which is a typical "in wash" pH encountered in a laundry washing method.

Sets of the pre-stained swatches were subjected to rinsing in the EDDS solutions followed by washing in a full scale laundry wash method using a bleach-containing detergent product. The rinse time in the EDDS solution was set to be either 2 or 5 minutes. The laundry washing method comprised a main wash in a Miele washing machine at 40° C. using soft water. The detergent product employed in this washing method had fast release of bleach, and had the composition of formulation A of EXAMPLE 1.

The effect of the pre-rinsing in the heavy metal ion sequestrant solution prior to washing was assessed by reference to sets of the pre-stained swatches subjected only to the full scale laundry wash method.

Bleachable stain removal was assessed both visually using the well known 4—point Scheffé scale utilising panel score units (PSU), and using the Macbeth spectometer to calculate a % stain removal value.

The following results were obtained:

| Rinse/Wash Protocol | % stain removal | PSU (Scheffé) VS wash only |
|---|---|---|
| Wash only | 87 | — |
| Rinsing for 2 minutes in EDDS solution followed by wash | 92 | +3* |
| Rinsing for 5 minutes in EDDS solution followed by wash | 97 | +3* |

*significant at the 95% confidence level

Marked bleachable stain removal benefits are observed for the swatches exposed to the heavy metal ion sequestrant solution prior to washing in the bleach-containing detergent product.

EXAMPLE 5

The wash/rinse protocol of Example 3 was repeated with the following variations:

1. The 0.005% of EDDS solution was replaced by a solution containing 0.005% EDDS and 0.05% sodium citrate, which was also buffered to pH 10.5.

2. The rinse time was set at 3 minutes.

3. Swatches (cotton) stained individually with the following stains were employed:

(a) Blood (EMPA)

(b) Coffee (c) Red wine (d) Cocoa (e) Blood, milk and ink (EMPA)

The swatches (a) and (e) were obtained from the EMPA organization. Swatches (b) to (d) were obtained by painting the stains onto prewashed 15 cm×15 cm samples of white cotton sheet.

Using this modified test protocol the effect of pre-rinsing the stained swatches in a heavy metal ion sequestrant/builder containing solution prior to washing was assessed, by comparison with the results obtained for the same stained swatches exposed solely to the laundry washing method, without any pre-rinsing step. The stain removal results were assessed using the Macbeth spectometer to calculate a % stain removal value.

The following results were obtained:

| Rinse/Wash protocol | % Stain removal | | | | |
|---|---|---|---|---|---|
| | Blood | Coffee | Red Wine | Cocoa | BMI |
| Wash only | 78 | 76 | 100 | 36 | 70 |
| Rinsing in EDDS/builder solution for 3 minutes prior to wash | 100 | 78 | 100 | 34 | 78 |

Enhanced stain removal performance is hence seen to be obtained when the rinsing in the builder/heavy metal ion sequestrant solution step was employed prior to the wash step.

We claim:

1. A detergent composition comprising:

(a) a heavy metal ion sequestrant;

(b) an organic peroxyacid bleaching system comprising:

(i) an inorganic perhydrate salt coated with a coating composition comprising organic binder and an inorganic salt selected from the group consisting of sulphates, silicates, carbonates and mixtures thereof; and (ii) an organic peroxyacid bleach precursor agglomerated with the organic binder;

wherein the organic binder is selected from the group consisting of $C_{10}$–$C_{20}$ alcohol ethoxylates, $C_{10}$–$C_{20}$ monoglycerol ethers, $C_{10}$–$C_{20}$ diglycerol ethers, $C_{10}$–$C_{20}$ fatty acids, polyvinylpyrrolidones, polyethylene glycols, copolymers of maleic anhydride and ethylene, copolymers of maleic anhydride and methylvinyl ether, copolymers of maleic anhydride and methacrylic acid, methylcellulose, carboxymethyl cellulose, ethylhydroxyethylcellulose, hydroxyethylcellulose, homopolymeric polycarboxylic acids and salts thereof, co-polymeric polycarboxylic acids and salts thereof, and mixtures thereof; and (c) a fabric softening agent selected from the group consisting of:

(i) from 0.5% to 5% by weight of the composition, of water-insoluble tertiary amines;

(ii) from 0.5% to 5% by weight of the composition, of di-long chain amides;

(iii) from 0.1% to 2% by weight of the composition, of polyethylene oxides; and (iv) mixtures thereof;

wherein in the T50 test method the time to achieve a concentration that is 50% of the ultimate concentration of the heavy metal ion sequestrant is less than 120 seconds and the time to achieve a concentration that is 50% of the ultimate concentration of the organic peroxyacid is more than 180 seconds.

2. A detergent composition according to claim 1 wherein the time to achieve a concentration that is 50% of the ultimate concentration of the organic peroxyacid is from 180 to 480 seconds.

3. A detergent composition comprising:

(a) a heavy metal ion sequestrant;

(b) an organic peroxyacid bleaching system; and (c) a polyalkenyl polyether having a molecular weight of from about 750,000 to about 4,000,000;

wherein a means is provided for delaying the release to a wash solution of said organic peroxyacid relative to the release of said heavy metal ion sequestrant such that in the T50 test method the time to achieve a concentration that is 50% of the ultimate concentration of said heavy metal ion sequestrant is at least 100 seconds less than the time to achieve a concentration that is 50% of the ultimate concentration of said organic peroxyacid; and wherein the composition is in the form of a gel.

4. A detergent composition according to claim 1 further comprising:

(c) a water soluble builder selected from the group consisting of carbonates, bicarbonates, borates, phosphates, silicates and mixtures thereof;

wherein a means is provided for delaying the release to a wash solution of said organic peroxyacid relative to the release of said water soluble builder such that in the T50 test method the time to achieve a concentration that is 50% of the ultimate concentration of said water soluble builder is less than 120 seconds.

5. A detergent composition according to claim 1 wherein said peroxyacid bleach precursor compound is selected from a peroxyacid bleach precursor compound which on perhydrolysis provides a peroxyacid which is (i) a perzbenzoic acid, or non-cationic substituted derivative thereof; or (ii) a cationic peroxyacid.

6. A detergent composition according to claim 5 wherein said peroxyacid bleach precursor compound is selected from the group consisting of a) an amide substituted bleach precursor of the general formula:

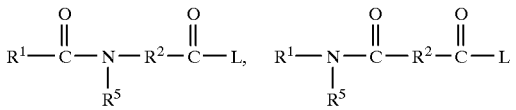

wherein $R^1$ is an aryl, or alkaryl group containing from 1 to 14 carbon atoms, $R^2$ is an arylene or alkarylene group containing from 1 to 14 carbon atoms, $R^5$ is H or an alkyl, aryl, or alkaryl group containing from 1 to 10 carbon atoms, and L is a leaving group;

b) an N-acylated lactam bleach precursor of the formula:

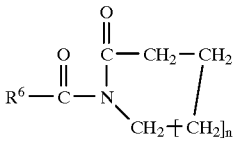

wherein n is from 0 to 8, and $R^6$ is an aryl, alkoxyaryl or alkaryl group containing from 1 to 12 carbons, or a substituted phenyl group containing from 6 to 18 carbon atoms;

and mixtures of a) and b).

7. A detergent composition according to claim 1 wherein said peroxyacid bleach precursor compound is

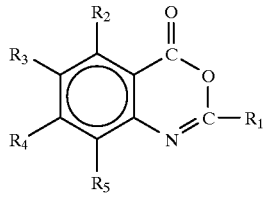

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, —$COOR_6$, wherein $R_6$ is H or an alkyl group and carbonyl functions.

8. A detergent composition according to claim 1 wherein said peroxyacid bleach precursor compound is tetraacetylethylenediamine.

9. A detergent composition according to claim 1 wherein said inorganic perhydrate salt is an alkali metal percarbonate.

10. A detergent composition according to claim 1 additionally containing a bleach catalyst.

11. A detergent composition according to claim 10 wherein said bleach catalyst is selected from the group consisting of $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-tri-methyl-1,4,7-triazacyclononane)$_2$-$(ClO_4)_2$; $Mn^{IV}{}_4(u\text{-}O)_6$(1,4,7-triazacy-clononane)$_4$-$(ClO_4)_2$; $Mn^{III}Mn^{IV}{}_4(u\text{-}O)_1(u\text{-}OAc)_2$(1,4,7-tri-methyl-1,4,7-triazacyclononane)$_2$-$(ClO_4)_3$; Mn(1,4,7-trimethyl-1,4,7-triaza-cyclononane$(OCH_3)_3$-$(PF_6)$; Co(2,2'-bispyridyl-amine)$Cl_2$; Di-(isothio-cyanato) bispyridylamine-cobalt (II); trisdipyridylamine-cobalt (II) per-chlorate; Co(2,2-bispyridylamine)$_2$-$O_2ClO_4$; Bis-(2,2'-bispyridylamine) copper(II) per-chlorate; tris(di-2-pyridylamine) iron (II) perchlorate; Mn gluconate; $Mn(CF_3SO_3)_2$; $Co(NH_3)_5Cl$; binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$ and mixtures thereof.

12. A detergent composition according to claim 1 which is free of chlorine bleach.

13. A washing method comprising the steps of:

(1) applying a bleach-free solution comprising from 0.005% to 1%, by weight, of a heavy metal ion sequestrant to a soiled substrate;

(2) allowing said solution to remain in contact with said soiled substrate; and (3) subsequently washing said soiled substrate with a bleach-containing detergent compositions;

wherein the heavy metal ion sequestrant is selected from the group consisting of ethylenediamine-N,N'-disuccinic acid, salts of ethylenediamine-N,N'-disuccinic acid and mixtures thereof.

14. A detergent composition according to claim 3, wherein the organic peroxyacid bleaching system comprises:

(i) an inorganic perhydrate salt coated with a coating composition comprising organic binder and an inorganic salt selected from the group consisting of sulphates, silicates, carbonates and mixtures thereof;

(ii) an organic peroxyacid bleach precursor agglomerated with organic binder; and (iii) a bleach catalyst;

wherein the organic binder is selected from the group consisting of $C_{10}$–$C_{20}$ alcohol ethoxylates, $C_{10}$–$C_{20}$ monoglycerol ethers, $C_{10}$–$C_{20}$ diglycerol ethers, $C_{10}$–$C_{20}$ fatty acids, polyvinylpyrrolidones, polyethylene glycols, copolymers of maleic anhydride and ethylene, copolymers of maleic anhydride and methylvinyl ether, copolymers of maleic anhydride and methacrylic acid, methylcellulose, carboxymethyl cellulose, ethylhydroxyethylcellulose, hydroxyethylcellulose, homopolymeric polycarboxylic acids and salts thereof, co-polymeric polycarboxylic acids and salts thereof, and mixtures thereof.

15. A detergent composition according to claim 14, wherein the peroxyacid bleach precursor, on perhydrolysis, provides a peroxyacid selected from the group consisting of (i) perbenzoic acid;

(ii) perbenzoic acid compounds having a functional group selected from the group consisting of alkyl, hydroxyl, alkoxy, halogen amine, nitrosyl and amide groups and mixtures thereof, (iii) cationic peroxyacids; and (iv) mixtures thereof.

16. A detergent composition according to claim 3, further comprising a suds suppressing system comprising:

(i) a polydimethylsiloxane;

(ii) silica;

(iii) a silicone glycol rake copolymer; and (iv) a $C_{16}$–$C_{18}$ ethoxylated alcohol with a degree of ethoxylation of from 5 to 50.

17. A detergent composition according to claim 3, further comprising from a fabric softening agent selected from the group consisting of:

(i) from 0.5% to 5%, by weight of the composition, of water-insoluble tertiary amines;

(ii) from 0.5% to 5%, by weight of the composition, of di-long chain amides;

(iii) from 0.1% to 2%, by weight of the composition, of polyethylene oxides; and (iv) mixtures thereof.

18. A detergent composition according to claim 4, wherein after the ultimate concentrations of heavy metal ion sequestrant, inorganic perhydrate bleach, peroxyacid precursor and water-soluble builder are achieved, the wash liquor comprises, by weight:

from 0.001% to 0.05%, heavy metal ion sequestrant;

more than 0.05% inorganic perhydrate bleach;

from 0.001% to 0.08% peroxyacid precursor; and from 0.005% to 0.4% water-soluble builder.

* * * * *